US007290808B2

(12) United States Patent
Furlong

(10) Patent No.: US 7,290,808 B2
(45) Date of Patent: Nov. 6, 2007

(54) ADJUSTABLE DOOR HANDLE

(75) Inventor: Jonathan W. Furlong, Colorado Springs, CO (US)

(73) Assignee: Schlage Lock Company, Indianapolis, IN (US)

( * ) Notice: Subject to any disclaimer, the term of this patent is extended or adjusted under 35 U.S.C. 154(b) by 290 days.

(21) Appl. No.: 10/758,924

(22) Filed: Jan. 16, 2004

(65) Prior Publication Data

US 2005/0156439 A1 Jul. 21, 2005

(51) Int. Cl.
*E05B 3/00* (2006.01)
*E05B 1/00* (2006.01)

(52) U.S. Cl. ..... 292/336.3; 292/347; 292/357; 292/DIG. 53; 16/412

(58) Field of Classification Search ..... 292/336.3, 292/347, 348, 352, DIG. 53, DIG. 54, DIG. 60, 292/DIG. 64, 357, 341.18; 16/412, 413, 16/429

See application file for complete search history.

(56) References Cited

U.S. PATENT DOCUMENTS

| | | | | | |
|---|---|---|---|---|---|
| 1,026,233 | A | * | 5/1912 | Zacsek | 292/336.3 |
| 1,059,952 | A | * | 4/1913 | Spooner | 292/336.3 |
| 1,143,898 | A | * | 6/1915 | Fournier | 220/759 |
| 1,810,350 | A | * | 6/1931 | Hines | 292/336.3 |
| 1,907,128 | A | * | 5/1933 | Steele | 16/412 |
| 2,001,666 | A | * | 5/1935 | Keil | 16/444 |
| 2,325,292 | A | * | 7/1943 | Westrope | 297/411.21 |
| 2,401,559 | A | * | 6/1946 | Falk | 292/165 |
| 2,976,072 | A | * | 3/1961 | Muttart | 292/336.3 |
| 3,107,113 | A | * | 10/1963 | Sconzo | 292/228 |
| 3,427,061 | A | * | 2/1969 | Gresham et al. | 292/353 |
| 3,523,322 | A | * | 8/1970 | Rossow | 16/412 |
| 3,591,224 | A | * | 7/1971 | Unter | 292/336.3 |
| 4,006,927 | A | * | 2/1977 | Recupero | 292/336.3 |
| 4,732,417 | A | * | 3/1988 | Yang | 292/142 |
| 4,982,986 | A | * | 1/1991 | Gressett et al. | 292/336.3 |
| 5,084,940 | A | | 2/1992 | Loffler et al. | |
| 5,088,778 | A | * | 2/1992 | Lin | 292/336.3 |
| 5,123,683 | A | * | 6/1992 | Solovieff | 292/172 |
| 5,476,295 | A | | 12/1995 | Smallegan et al. | |
| 5,593,193 | A | * | 1/1997 | Heim | 292/336.3 |
| 5,624,141 | A | * | 4/1997 | Kuo et al. | 292/165 |
| 5,700,044 | A | * | 12/1997 | Wartian | 292/336.3 |
| 5,762,387 | A | * | 6/1998 | Edgerly et al. | 292/357 |
| 5,810,402 | A | * | 9/1998 | Armstrong | 292/39 |
| 6,557,909 | B2 | | 5/2003 | Morris | |
| 6,655,108 | B2 | | 12/2003 | Larson et al. | |
| 2006/0162127 | A1 | * | 7/2006 | Huang et al. | 16/412 |

FOREIGN PATENT DOCUMENTS

| | | | |
|---|---|---|---|
| DE | 10010709 | * | 8/2001 |
| GB | 1076140 | * | 2/2001 |

* cited by examiner

*Primary Examiner*—Carlos Lugo
(74) *Attorney, Agent, or Firm*—Michael Best & Friedrich LLP

(57) ABSTRACT

A door handle assembly attachable to a door. The door handle assembly includes a handle coupled to the door and a latch bolt coupled to the handle and movable along a latch bolt axis between an extended position and a retracted position. An attachment member defines an attachment axis. The attachment member is movable relative to the handle between a first position and a second position.

8 Claims, 7 Drawing Sheets

ADJUSTABLE DOOR HANDLE

BACKGROUND

The present invention generally relates to door handles, and particularly to door handles that are attachable to pre-fabricated doors.

Doors are often manufactured for use with particular handle hardware in mind. These doors can be manufactured to receive standard door handle hardware without adjustment. Likewise, replacement hardware for existing doors can be easily installed if the door and the hardware are manufactured using common standard dimensions. Alternatively, new versions of worn-out hardware can be used to replace the old or worn hardware to assure a proper fit.

However, as is often the case, new door handle hardware is not sized to match previous hardware, or holes drilled in the door are inaccurately positioned making the installation of the door handle hardware difficult.

SUMMARY

The present invention generally provides a door handle assembly attachable to a door. The door handle assembly includes a handle coupled to the door and a latch bolt coupled to the handle and movable along a latch bolt axis between an extended position and a retracted position. An attachment member defines an attachment axis. The attachment member is movable relative to the handle between a first position and a second position.

In another construction, the present invention generally provides a door including a panel portion defining a first surface, a second surface, a first aperture, and a second aperture. A closing mechanism is at least partially disposed within the first aperture. The closing mechanism includes a latch bolt movable along a latch bolt axis. A first cover is disposed adjacent the first surface and is positioned to at least partially cover the first aperture. A second cover is disposed adjacent the second surface and is positioned to at least partially cover the first aperture. A mounting assembly is coupled to the first cover and includes an attachment member. The attachment member is movable along an adjustment axis to align the attachment member with the second aperture.

In yet another construction, the present invention generally provides a method of mounting a door handle assembly to a door including a first aperture and a second aperture. The method includes the steps of positioning a closing mechanism at least partially within the first aperture and covering the first aperture with a first cover and a second cover. The method also includes coupling the first cover, the second cover, and the closing mechanism to the door and coupling an adjustable mounting assembly to the first cover. The method further includes adjusting the position of the adjustable mounting assembly to align the adjustable mounting assembly with the second aperture.

BRIEF DESCRIPTION OF THE DRAWINGS

The detailed description particularly refers to the accompanying figures in which.

Figure 1:
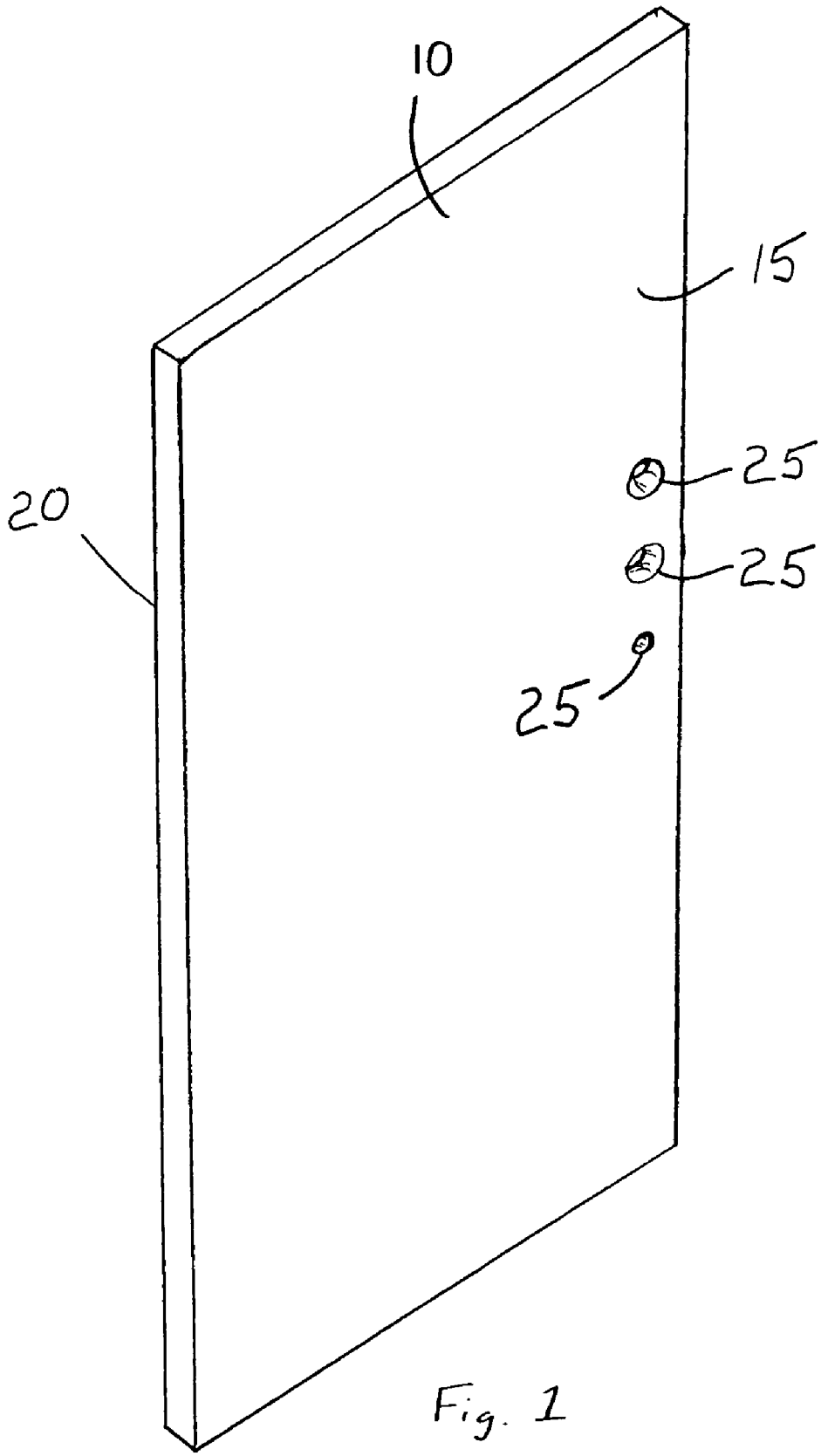
FIG. 1 is a perspective view of a door.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "having", "including", and "comprising" and variations thereof as used herein is meant to encompass the items listed thereafter and equivalents thereof as well as additional items. The use of letters to identify elements of a method or process is simply for identification and is not meant to indicate that the elements should be performed in a particular order.

DETAILED DESCRIPTION OF THE DRAWINGS

FIG. 1 illustrates a door 10 of the type commonly found in residential buildings. The door 10 includes a first surface 15, a second surface 20, and several apertures 25. The apertures 25 may be formed during the manufacture of the door 10 and may be located in standard positions or may be drilled by the end user prior to installation of the door 10. The apertures 25 may extend through the door 10 or may extend only partially through the door 10 as is required by the particular door hardware being installed.

Figure 2:
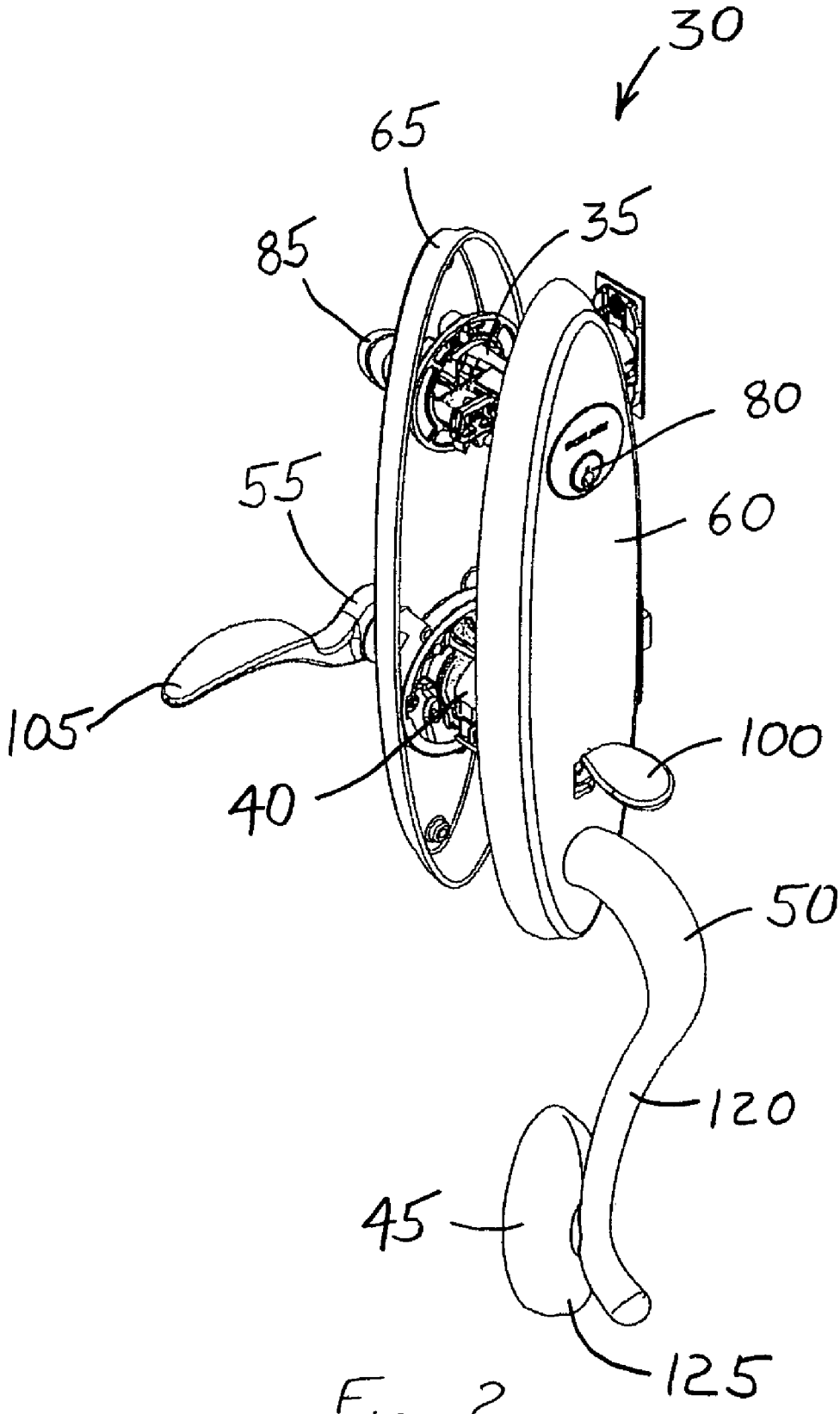
FIG. 2 is a perspective view of a door handle assembly embodying the present invention.
Figure 3:
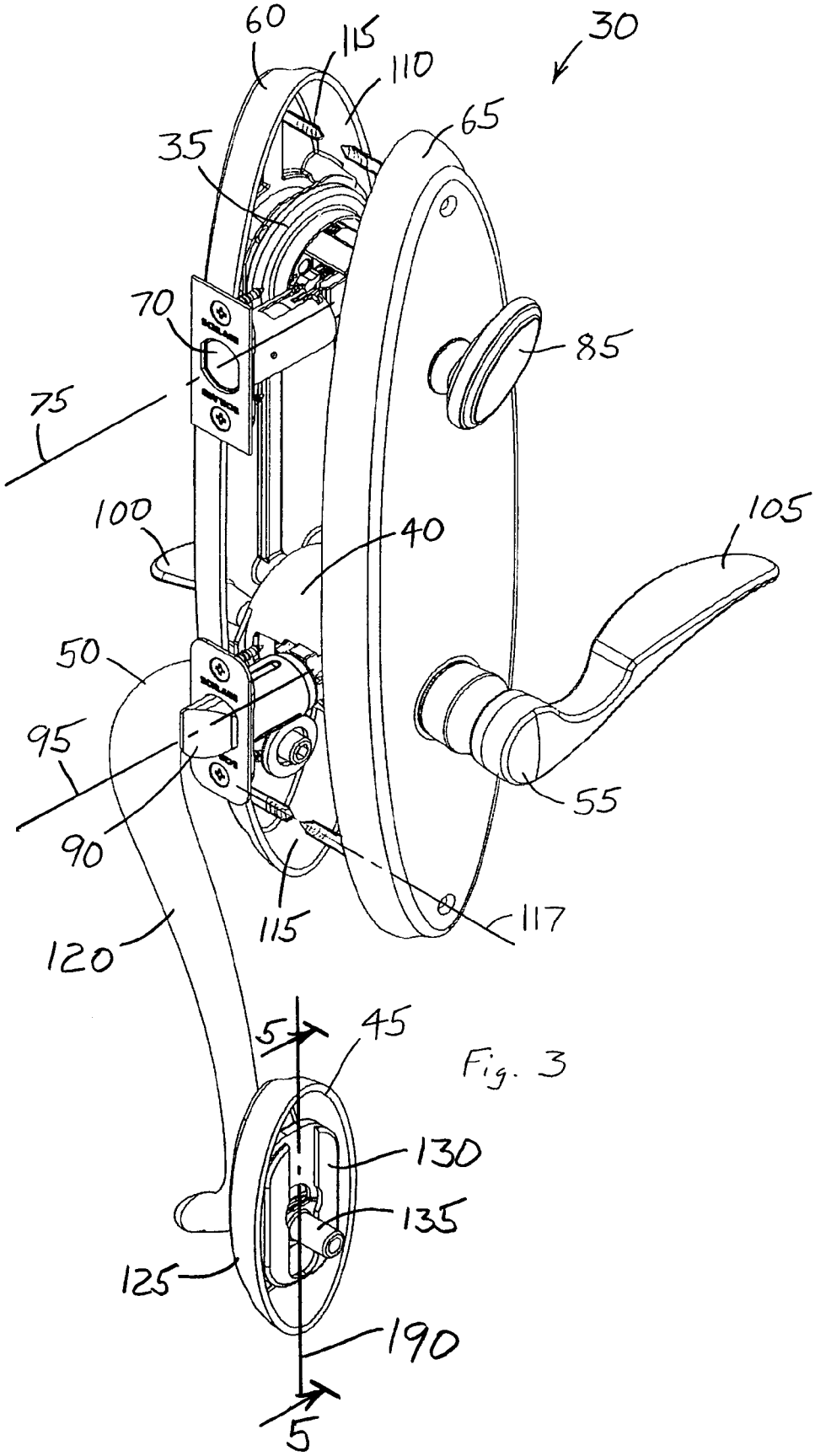
FIG. 3 is a perspective view of the door handle assembly of FIG. 2.

Turning to FIGS. 2 and 3, a door handle assembly 30 embodying the present invention is illustrated. The door handle assembly 30 is suited for installation into a door 10 such as the door 10 illustrated in FIG. 1. The door handle assembly 30 includes a dead bolt assembly 35, a closing mechanism 40, a mounting assembly 45, a first handle 50, a second handle 55, a first cover 60, and a second cover 65. The dead bolt assembly 35 includes a dead bolt spindle 70 that is movable along an axis 75 to lock the door 10 in a closed position. A keyhole 80 is provided on one side of the dead bolt assembly 35 and a hand knob 85 is provided on the opposite side to allow for the opening or closing of the dead bolt spindle 70. In other constructions, keyholes can be provided on both sides of the door 10. It should be noted that the presence of the deadbolt assembly 35 is not necessary for the function of the invention. As such, constructions that do not include deadbolt assemblies 35 may also employ the present invention.

The closing mechanism 40 includes a latch bolt 90 that moves along a latch axis 95 between an open position and a closed position. When in the closed position, the latch bolt 90 can engage an aperture in a door frame to maintain the door 10 in a closed position. The first handle 50 and the second handle 55 are mechanically coupled to the closing mechanism 40 to facilitate movement of the latch bolt 90. In the illustrated construction, the first handle 50 includes a thumb actuator 100 that, when actuated, moves the latch bolt 90 to the open position. The second handle 55 includes a lever 105 that is pivoted by the user to move the latch bolt 90 between the opened and the closed position. In the illustrated construction, the second handle 55 and the lever 105 are integrated into a single component. Other constructions may include a lever that attaches to the handle 55. While the present construction illustrates different handle types on the two sides of the door 10, there is no requirement that the handle types be different. In addition, other types of handles (e.g., doorknobs, pull levers, push bars, and the like) may be used with the present invention. Furthermore, in some constructions, the closing mechanism 40 may include a locking mechanism that allows a user to lock the door 10.

The first cover 60 and the second cover 65 are positioned to cover the dead bolt assembly 35 and the closing mechanism 40 after they are installed in the door 10. A first attachment member 110 passes through or partially through the door to interconnect the first cover 60, the second cover 65, and the door 10. In preferred constructions, the first attachment member 110 includes one or more screws 115 that are positioned substantially perpendicular to the latch axis 95. The screws 115 are generally parallel to an attachment axis 117 that is generally perpendicular to the latch axis 95. The screws pass through the covers and thread into the door to hold the covers in place. In addition to the screws 115, a first set of connectors (e.g., bolts, screws, and the like) connect the first cover 60 to the closing mechanism 40 and a second set of connectors connect the second cover 65 to the closing mechanism 40.

The first handle 50 includes a pull member 120 disposed below the thumb actuator 100. The pull member 120 is shaped to allow a user to grasp the pull member 120 and pull open the door 10. One end of the pull member 120 attaches to the first cover 60 and the opposite end attaches to the mounting assembly 45. The mounting assembly 45 attaches to the door 10 to complete the connection between the door 10 and the door handle assembly 30.

Figure 4:
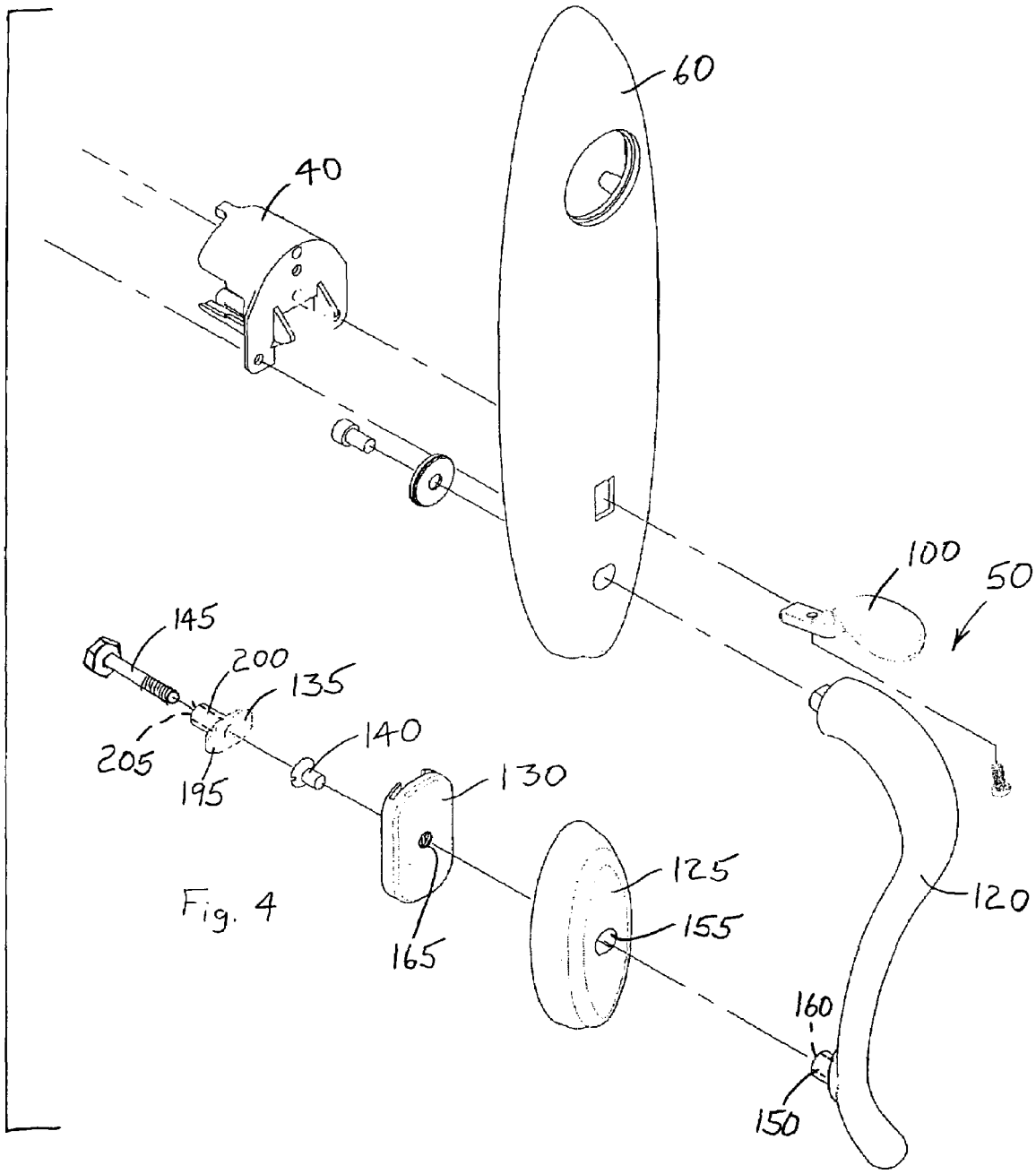
FIG. 4 is an exploded view of a portion of the door handle assembly of FIG. 2.
Figure 5:
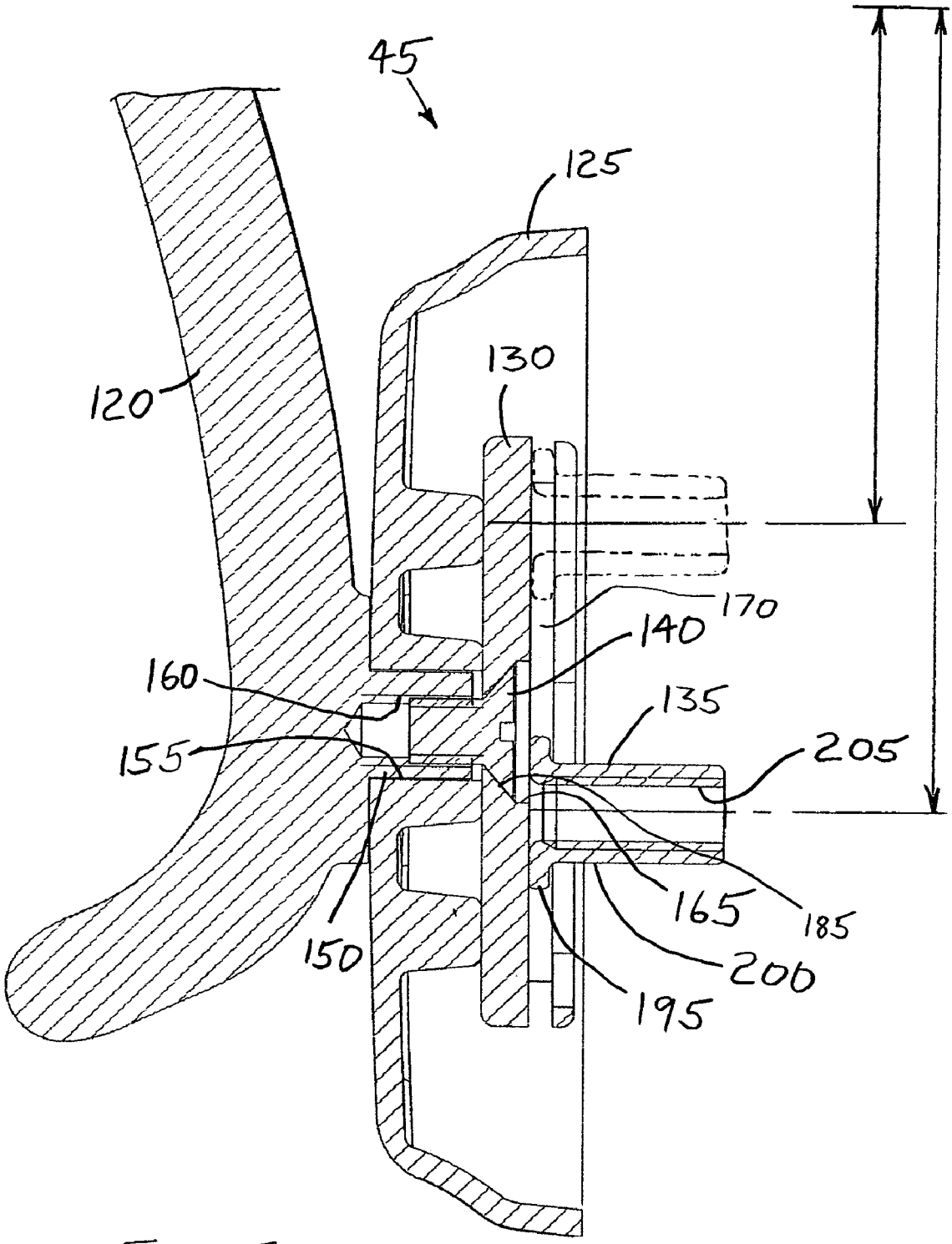
FIG. 5 is a sectional view of a portion of the door handle assembly taken along lines 5-5 of FIG. 3.

The mounting assembly 45, best illustrated in FIGS. 4 and 5, attaches to the pull member 120 and includes a cover 125, a base 130, an attachment in the form of a slider 135, a screw 140, and a bolt 145. The pull member 120 includes a boss 150 that fits within a bore 155 in the cover 125. The boss 150 includes a threaded bore 160 sized to receive the screw 140. The base 130 is positioned within the cover 125 such that the cover 125 is sandwiched between the pull member 120 and the base 130. The screw 140 is then threaded into the threaded bore 160 to fixedly attach the cover 125 and the base 130 to the pull member 120.

Figure 6:
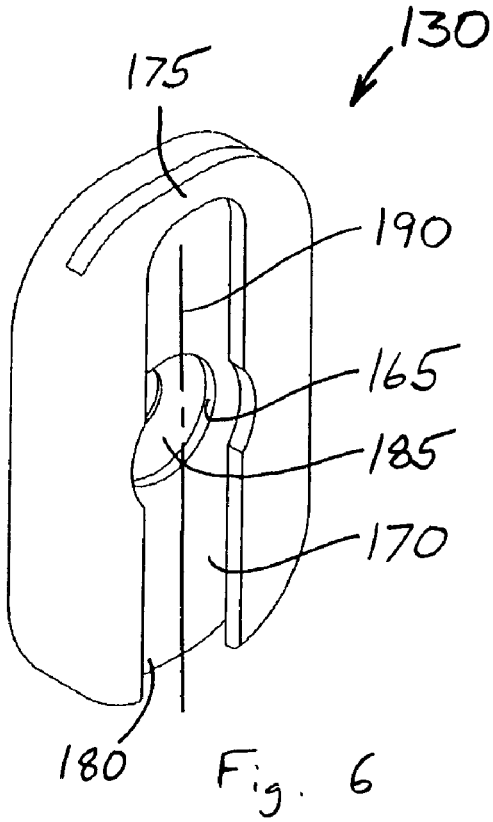
FIG. 6 is a perspective view of a base.

The base 130, illustrated in FIG. 6, includes a bore 165 sized to receive the screw 140 and a slot 170 having a closed end 175 and an open end 180. The bore 165 preferably includes a counterbore or a countersink 185 that receives the head of the screw 140. This allows the screw 140 to be positioned adjacent the slot 170 without the screw head protruding into the open slot 170. The slider 135, shown in FIG. 7, enters the base 130 at the open end 180 and is movable along an adjustment axis 190 (as shown in FIGS. 3 and 6) between the open end 180 and the closed end 175. The closed end 175 limits the movement of the slider 135 but is not necessary for the invention to function. Other bases 130 may include two open ends rather than the one open end 180 illustrated herein.

Figure 7:
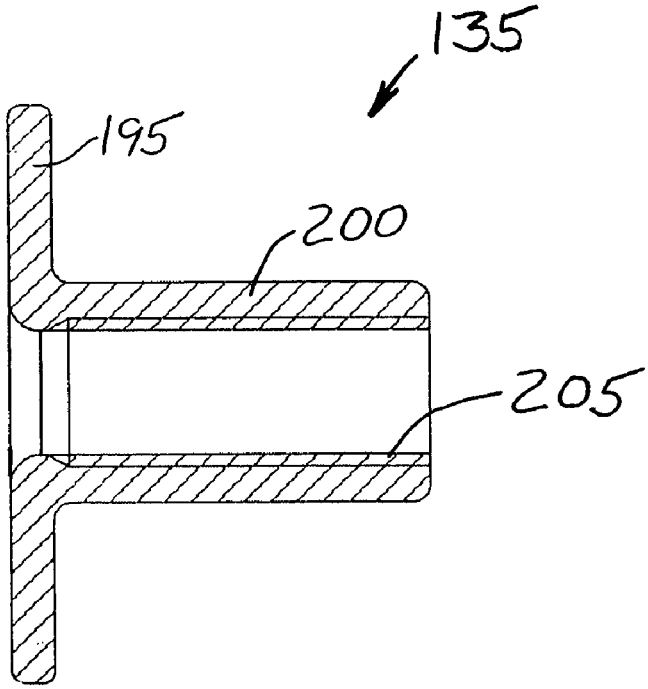
FIG. 7 is a sectional view of a slider.
Figure 8:
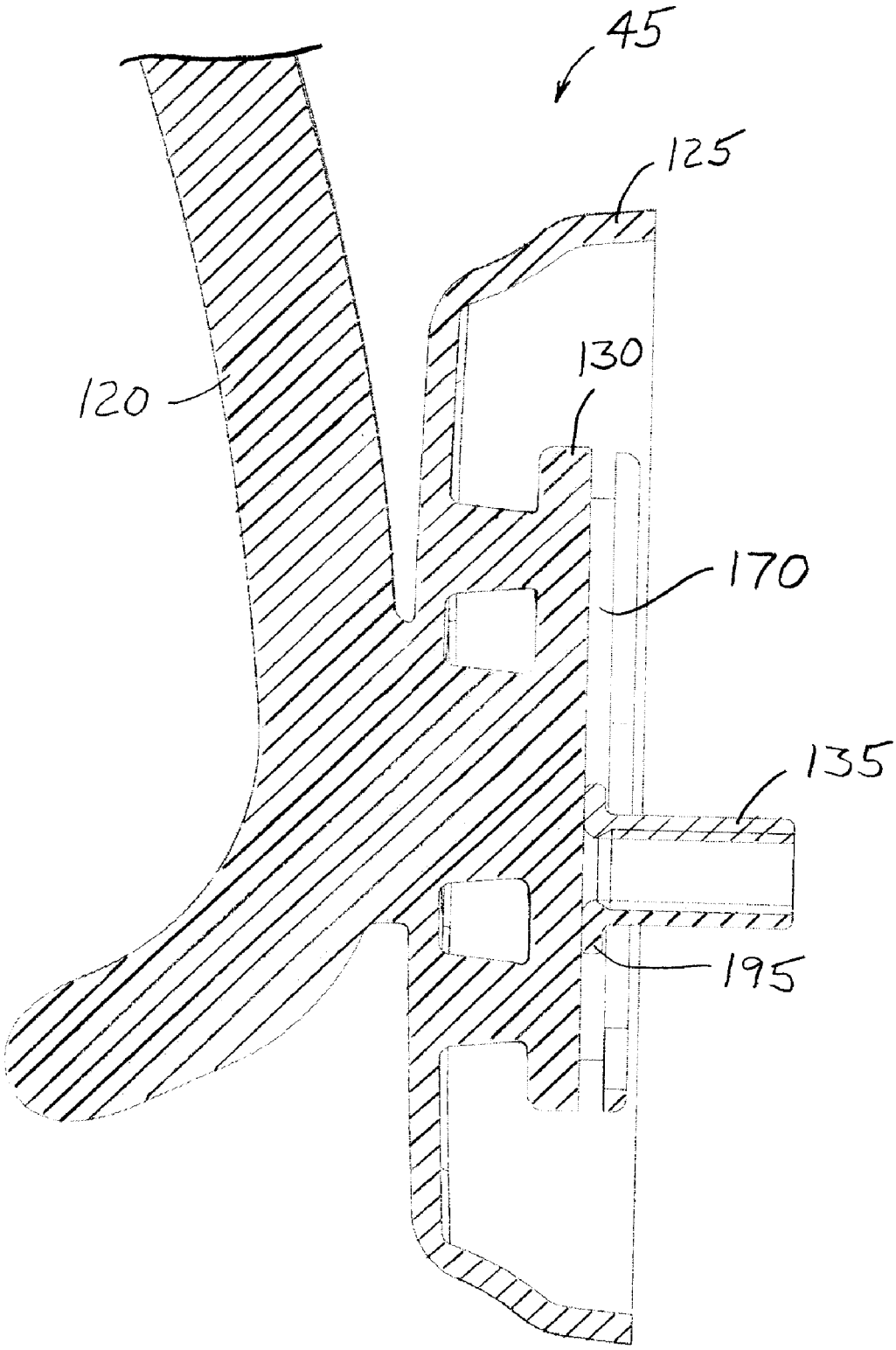
FIG. 8 is a sectional view of a portion of another door handle assembly taken along lines 5-5 of a door handle assembly similar to that of FIG. 3.

The slider 135 illustrated in FIG. 7 includes a head portion 195 and a body portion 200. The head portion 195 engages the slot 170 in the base 130 and facilitates the movement of the slider 135 along the adjustment axis 190 (shown in FIG. 3). The body portion 200 includes a threaded bore 205 sized to receive the bolt 145. Thus, to attach the mounting assembly 40 to the door 10, the bolt 145 passes through, or at least partially through, the door 10 and threadably engages the slider 135. As such, the slider 135 acts as a second attachment member.

To attach the door handle assembly 30 to the door 10, the user first forms the necessary holes or apertures 25 in the door 10. As discussed, some doors 10 are manufactured with the necessary holes 25, while others require the placement of the holes 25 by the end user. For the handle assembly 30 illustrated herein, three holes 25 in the door 10 are required. Of course other types of handle assemblies may require more than three holes 25 or less than three holes 25 to properly attach to the door 10.

The deadbolt assembly 35 and the closing mechanism 40 are positioned at least partially within two of the holes 25 such that the dead bolt spindle 70 and latch bolt 90 may move in and out of the side surface of the door 10. With the deadbolt assembly 35 and closing mechanism 40 in place, the handles 50, 55 and covers 60, 65 can be attached to the door 10. In the illustrated construction, the screws 115 that attach the covers 60, 65 to the door 10 extend at least part way through the second cover 65 and the door 10 in a direction substantially perpendicular to the dead bolt spindle 70 and the latch bolt 90. The screws 115 may engage the closing mechanism 40 before threadably engaging the first cover 60.

The slider 135 is installed in the slot 170 and is adjusted such that it aligns with the remaining aperture 25 in the door 10. FIG. 7 illustrates the slider 135 in two possible positions, with one of the positions shown in broken lines. As can be seen, moving the slider 135 between these two positions varies the distance of the slider from a fixed reference, such as the latch bolt axis 75. The slider 135 is substantially free to move along the adjustment axis 190, which is substantially perpendicular to the latch axis 95 and to the mounting screws 115. With the slider 135 positioned as desired, the bolt 145 engages the slider 135 and is tightened to complete the attachment of the handle assembly 30 to the door 10.

It should be noted that some constructions employ a handle 50 that includes a slot 170 such that the shoulder portion (head portion 195) of the attachment member engages the slot 170.

Although the invention has been described in detail with reference to certain preferred embodiments, variations and modifications exist within the scope and spirit of the invention as described and defined in the following claims.

What is claimed is:

1. A door handle assembly attachable to a door that defines a first side and a second side, the door handle assembly comprising:

a first cover coupled to the first side;

a second cover coupled to the first side of the door in a position separate from the first cover;

a handle interconnecting the first cover and the second cover and including a first attachment portion and a second attachment portion spaced apart a distance to couple the handle to the door;

an actuator coupled to the door;

a latch bolt coupled to the actuator and movable along a latch bolt axis between an extended position and a retracted position; and an attachment member at least partially defining the second attachment portion and defining an adjustment axis that is substantially parallel to the attachment surface, the attachment member being movable along the adjustment axis relative to the handle to move the second attachment portion between a first position and a second position to vary the distance between the first attachment portion and the second attachment portion.

2. The door handle assembly of claim 1, wherein the first position is a first distance from the latch bolt axis and the second position is a second distance from the latch bolt axis, the first distance being different from the second distance.

3. The door handle assembly of claim 1, wherein the latch bolt axis is substantially perpendicular to the adjustment axis.

4. The door handle assembly of claim 1, wherein the handle includes a slot and the attachment member includes a shoulder portion engageable with the slot.

5. The door handle assembly of claim 1, wherein the handle is coupled to a base that defines a slot.

6. A door handle assembly attachable to a first side of a door, the door handle assembly comprising:

a first cover directly connected to the first side of the door;

a second cover separate from the first cover and directly connected to the first side of the door;

a handle coupled to the first cover and the second cover;

an actuator coupled to the door;

a latch bolt coupled to the actuator and movable along a latch bolt axis between an extended position and a retracted position; and an attachment member defining an adjustment axis, the attachment member being movable relative to the handle between a first position and a second position, wherein the handle includes a base that defines a slot, and wherein the attachment member includes a T-shaped slider slidably engageable with the slot.

7. The door handle assembly of claim 6, further comprising a cover member coupled to the handle to at least partially cover the attachment member.

8. The door handle assembly of claim 6, further comprising a bolt threadably engageable with the T-shaped slider.

* * * * *